US005943873A

United States Patent [19]

Chung

[11] Patent Number: 5,943,873

[45] Date of Patent: Aug. 31, 1999

[54] ROOM AIR CONDITIONER BOX HAVING ISOLATION WALL SECTIONS

[75] Inventor: Sang-Hyeon Chung, Incheon, Rep. of Korea

[73] Assignee: Daewoo Electronics Co., Ltd., Seoul, Rep. of Korea

[21] Appl. No.: 09/086,516

[22] Filed: May 28, 1998

[30] Foreign Application Priority Data

May 29, 1997 [KR] Rep. of Korea ..... 97-21761

[51] Int. Cl.[6] ..... F25D 23/12

[52] U.S. Cl. ..... 62/262; 62/296

[58] Field of Search ..... 62/262, 296, 298

[56] References Cited

U.S. PATENT DOCUMENTS

| | | | |
|---|---|---|---|
| 3,364,989 | 1/1968 | Marsteller | 62/262 |
| 3,756,039 | 9/1973 | Riello | 62/262 |
| 4,102,148 | 7/1978 | Matthews et al. | 62/77 |
| 4,607,499 | 8/1986 | Bolton | 62/262 |
| 4,977,750 | 12/1990 | Metcalfe | 62/77 |
| 5,085,057 | 2/1992 | Thompson et al. | 62/262 |
| 5,415,011 | 5/1995 | Gilmore | 62/262 |
| 5,638,693 | 6/1997 | Baek | 62/262 |
| 5,706,672 | 1/1998 | Miyazaki | 62/427 |

FOREIGN PATENT DOCUMENTS

| | | |
|---|---|---|
| 0 738 857 | 10/1996 | European Pat. Off. . |
| 3 199832 | 8/1991 | Japan . |
| 2 167 851 | 6/1986 | United Kingdom . |

*Primary Examiner*—William Doerrler
*Attorney, Agent, or Firm*—Pillsbury Madison & Sutro LLP

[57] ABSTRACT

Room air conditioner box which is easily assembled/disassembled and reduces a noise. The box has a base plate, a cap member assembled to the base plate, a grill section for uniformly dispersing a chilled air passed around an evaporator, a first isolation wall section for separating an inner space into two sub-spaces so as to prevent a heat exchange therebetween and to attenuate the noise, a second isolation wall section for guiding the air drawn thereinto toward a condenser. The first isolation wall section includes a main body which receives a blower and guides the air passed around the evaporator toward the grill section, an evaporator cover assembled to the main body for guiding air drawn toward the main body, and a head section assembled to the main body for exposing an upper portion of the main body. The main body, the head section and the evaporator cover are manufactured by the injection molding, can be easily assembled/disassembled with/from each other and can attenuate the noise.

8 Claims, 5 Drawing Sheets

100

200

ROOM AIR CONDITIONER BOX HAVING ISOLATION WALL SECTIONS

BACKGROUND OF THE INVENTION

1. Field of the Invention

The present invention relates to a room air conditioner, and more particularly to a room air conditioner box having isolation wall sections which can be easily assembled/disassembled with/from each other and can reduce a noise while the room air conditioner is being operated.

2. Description of the Prior Art

Generally, an air conditioner is an apparatus for conditioning air in a house or an office with a properly adjusted indoor temperature and humidity agreeable to a human body. In practice, the air conditioner may be controlled to keep an indoor temperature of about 28° C. and an indoor humidity of about 65–75% during hot summer days, while keeping the indoor temperature of about 18° C. and the indoor humidity of about 55–70% during cold winter days.

In such an air conditioner, and especially in a room air conditioner, all the operative components thereof are assembled in one unit. Within the room air conditioner unit, an evaporator and an exhaust grill sections for uniformly dispersing the conditioned air to a room are located toward the room, and a condenser part which is super-heated during its operation is extended out of the room so as to be cooled by outdoor air.

FIGS. 1 and 2 show an exterior appearance and a structure of a conventional room air conditioner 100. Referring to FIGS. 1 and 2, conventional room air conditioner 100, to perform refrigeration cycles, has a compressor 1 for compressing a refrigerant gas with a high pressure and a high temperature, a condenser 2 for gradually condensing the high temperature and high pressure refrigerant gas transferred from compressor 1 to a liquid phase by a heat exchange, an expansion valve 3 for reducing the pressure of the liquid-phase refrigerant transferred from condenser 2 to change the liquid-phase refrigerant to a low temperature refrigerant in a multiphase of liquid-gas, and an evaporator 4 for evaporating the low temperature multiphase refrigerant with an absorption of environmental heat and transferring the evaporated refrigerant gas to compressor 1.

Conventional room air conditioner 100 further has a base plate 5 for supporting all of the operative components thereon, first and second isolation wall sections 6 and 7 vertically mounted on base plate 5 with predetermined intervals to separate the evaporator part from the condenser part, a driving motor 9 fixed to a motor mount 8 which is vertically assembled on base plate 5, located between first and second isolation wall sections 6 and 7, a blower 10 and a fan 11 fixed to both ends of a driving shaft 9*a* of driving motor 9, a control unit 12 assembled on first isolation wall section 6 for the control of the room temperature, a grill section 13 assembled in front of first isolation wall section 6 for allowing indoor air to pass therethrough and uniformly dispersing the conditioned air to a room, and a cap member 14 mounted on base plate 5 to cover all the operative components mounted on base plate 5.

First isolation wall section 6 has a barrier 51 vertically assembled on base plate 5 to separate and isolate the evaporator part from the condenser part, a scroll 52 assembled with base plate 5 and barrier 51 for guiding the circulation of the air drawn by blower 10 and conditioned through evaporator 4 to the room and gathering a condensate falling from evaporator 4 for drainage out of the unit, an evaporator cover 53 assembled with scroll 52 for guiding the circulation of the conditioned air to the room in cooperation with scroll 52 so that the conditioned air is expelled through grill section 13, a brace 54 assembled with second isolation wall section 7 and barrier 51 for providing support between first and second isolation wall sections 6 and 7 at predetermined intervals, and fixing members 55 assembled on the lower part of scroll 52 to fix a temperature sensor (not shown) for sensing the temperature of the drawn indoor air.

Second isolation wall section 7 has a structure assembled on base plate 5 to separate and isolate the condenser part from the evaporator part. Second isolation wall section 7 guides the outdoor air drawn by fan 11 so that the drawn air passes through condenser 2 and then is expelled outside thereof through an outlet port 14*a* of cap member 14.

However, the conventional room air conditioner box has drawbacks in that first isolation wall section 6 is composed of a large number of parts such as metal barrier 51, scroll 52, evaporator cover 53, brace 54, and fixing members 55, and these parts are separately prepared by a press bending before assembly and thus relatively high material and labor costs are involved during the manufacturing process. Further, since a large number of parts of first isolation wall section 6 must be assembled one-by-one on base plate 5 by assembling screws, such assembling work would greatly reduce the productivity of the room air conditioner.

Also, when there is an error in blower 10, and accordingly, when blower 10 and driving motor 9 must be disassembled from room air conditioner 100, all of scroll 52, barrier 51 and evaporator cover 53 must be disassembled from room air conditioner 100.

Meanwhile, U.S. Pat. No. 4,607,499 discloses an air conditioner box separable into upper and lower parts thereof. The air conditioner box has an upper housing in which upper flanges are outwardly and upwardly formed along lower edges of both side walls of the upper housing, a lower housing in which lower flanges are outwardly and downwardly formed along upper edges of both side walls of the lower housing, and channel members, each of which is slidably disposed around the upper and lower flanges. However, even though the assembling and disassembling of the air conditioner box is simple, since the structure is assembled only by the channel members, the structural stability thereof is low.

SUMMARY OF THE INVENTION

The present invention is intended to overcome the above-described disadvantages. Therefore, it is an object of the present invention to provide a room air conditioner box having isolation wall sections which are easily assembled/disassembled with/from each other and can attenuate a noise while the room air conditioner is being operated.

In order to achieve the above object of the present invention, there is provided a room air conditioner box, which comprises:

a base plate having a rectangular shape;

a cap member assembled at an upper portion of the base plate, the cap member forming a box-shaped space therein together with the base plate, the cap member being formed at a first side wall thereof with a first opening, being formed at a predetermined position of a second side wall thereof oppositely positioned to the first side wall with a second opening so as to allow air to pass therethrough, and being formed at a predetermined position of an upper wall thereof with an outlet port;

a grill section for uniformly and forwardly dispersing a chilled air passed around an evaporator, the grill section being assembled to a circumferential edge portion of the first opening of the cap member;

a first isolation wall section mounted on the base plate for separating the box-shaped space into first and second sub-spaces which respectively face the first and second side walls, preventing a heat exchange between the first and second sub-spaces and attenuating a noise while a room air conditioner is being operated, an upper of which is separable; and a second isolation wall section for guiding the air drawn into the second sub-space through the second opening formed at the second side wall toward a condenser and guiding the air passed around the condenser to the outlet port formed at the cap member.

The first isolation wall section includes a main body which receives a blower coupled to a driving shaft of a driving motor fixed to a motor mount mounted at the base plate and guides the air passed around the evaporator installed in the first sub-space toward the grill section, an evaporator cover assembled to a front portion of the main body for guiding air drawn by the blower toward the main body, and a head section assembled to an upper portion of the main body for exposing an upper portion of the main body.

The main body is formed at a first side of the upper portion thereof with a first recess having a cylindrical lower surface for receiving the blower therein and is formed at a second side of the upper portion thereof oppositely positioned to the first side with a duct which is arcuately bent from the first recess toward the grill section, the duct being communicated with the first recess for guiding the air flowing thereinto from the first recess toward the grill section and being formed therebelow with a first space separated therefrom by a partition for receiving a control unit therein.

According to a preferred embodiment of the present invention, a rear wall section of the first recess includes first and second rear walls which are spaced apart from each other by a predetermined interval so as to form a second space therebetween for attenuating the noise while the room air conditioner is being operated, the first and second rear walls being formed at upper portions thereof with first and second cut portions having trapezoidal shapes, respectively, the first and second cut portions being formed at lower edges thereof corresponding to a position of the driving shaft of the driving motor with first grooves having half circular shapes so as to allow the driving shaft to penetrate therethrough when the driving motor is installed in the room air conditioner box.

According to a preferred embodiment of the present invention, a third space is formed between a rear wall of the duct and a third rear wall integrally extending from the second rear wall for attenuating the noise while the room air conditioner is being operated.

According to a preferred embodiment of the present invention, the second and third rear walls are formed at bottom edges thereof with a rib rearwardly protruding therefrom for fixing the main body to the base plate when the room air conditioner is assembled.

According to a preferred embodiment of the present invention, the head section is formed at an underside portion thereof corresponding to the first recess of the main body with a second recess oppositely shaped with respect to the first recess for forming a cylindrical cavity together with the first recess when the head section is assembled with the main body so as to stably receive the blower therein.

According to a preferred embodiment of the present invention, a circumferential underside portion of the head section has a shape corresponding to a shape of an upper circumferential portion of the first rear wall, the second and third rear walls are formed at a connecting portion therebetween with a vertically elongated groove, and the head section is formed at an underside position thereof corresponding to a position of the vertically elongated groove with a vertically elongated rib, the circumferential underside portion of the head section being engaged with upper circumferential portions of the first and second rear walls, the vertically elongated rib being slidably inserted into the vertically elongated groove so that the head section is easily assembled/disassembled with/from the main body.

The head section is formed at a position of the circumferential underside portion thereof corresponding to a position of the first grooves formed at the first and second cut portion of the main body with a second groove so as to form a hole together with the first grooves for allowing the driving shaft of the driving motor to stably penetrate therethrough when the head section is assembled with the main body.

The evaporator cover is a hollow rectangular plate, an inner portion of which forms a second space for attenuating the noise while the room air conditioner is being operated, the evaporator cover being formed at a center portion thereof with a third opening for introducing the air drawn by the blower to the first recess of the main body, being formed at a side wall thereof with a vertically elongated groove which is engaged with a side wall of the first recess, and being formed at a rear portion thereof with a shoulder having a shape corresponding to a shape of the bottom surface of the first recess so as to be engaged with the first recess when the evaporator cover is assembled with the main body so that the evaporator cover is easily assembled/disassembled with/from the main body.

Meanwhile, the evaporator cover is formed at a lower portion thereof with a condensate pan for receiving a condensate falling from an outer surface of the evaporator and draining the condensate out of the room air conditioner box.

In the room air conditioner box having isolation wall sections according to the present invention, the main body, the head section and the evaporator cover are manufactured by injection molding so that they can be easily assembled/disassembled with/from each other and can attenuate the noise while the room air conditioner is being operated.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a room air conditioner 200 having isolation wall sections according to a preferred embodiment of the present invention will be explained in more detail with reference to the accompanying drawings.

Figure 1:
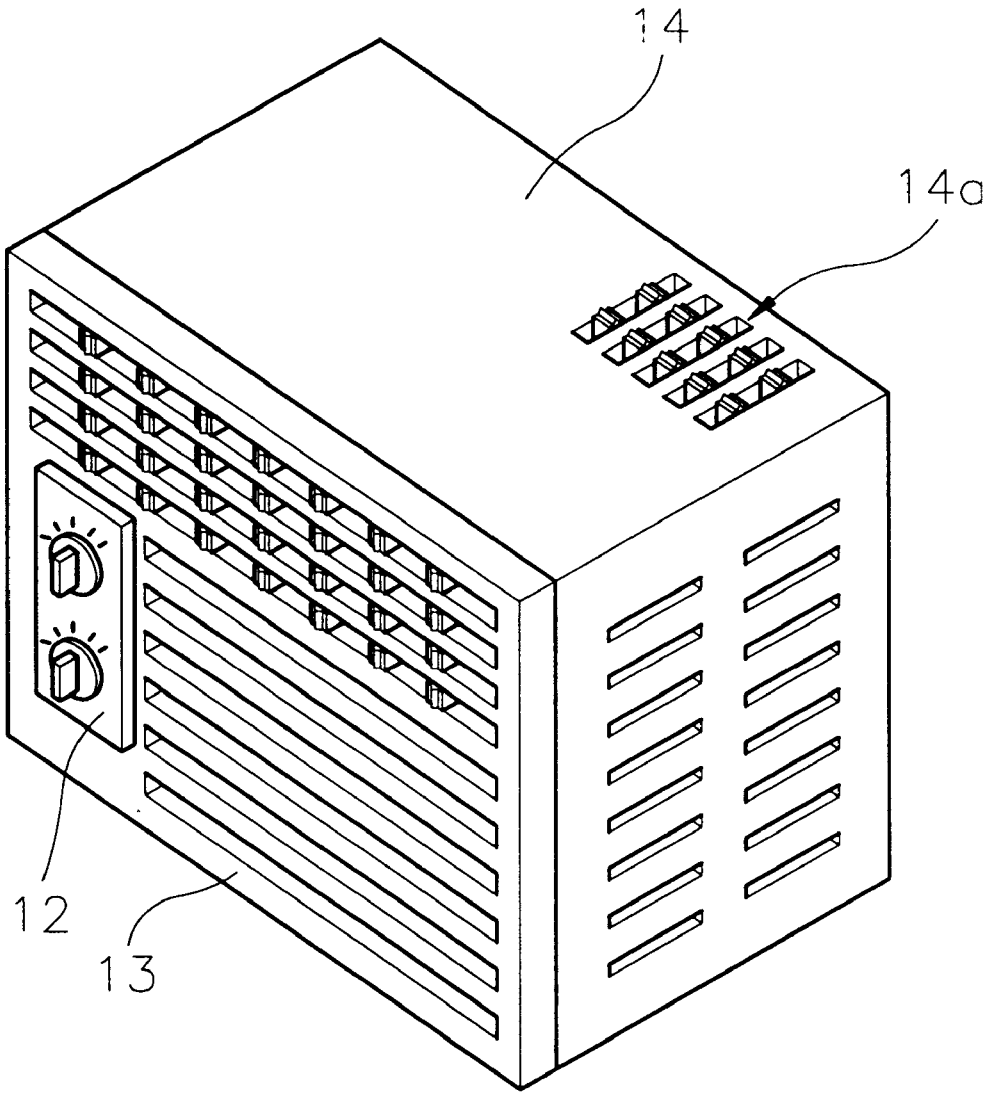
FIG. 1 (PRIOR ART)
FIG. 1 is a perspective view of a conventional room air conditioner.
Figure 2:
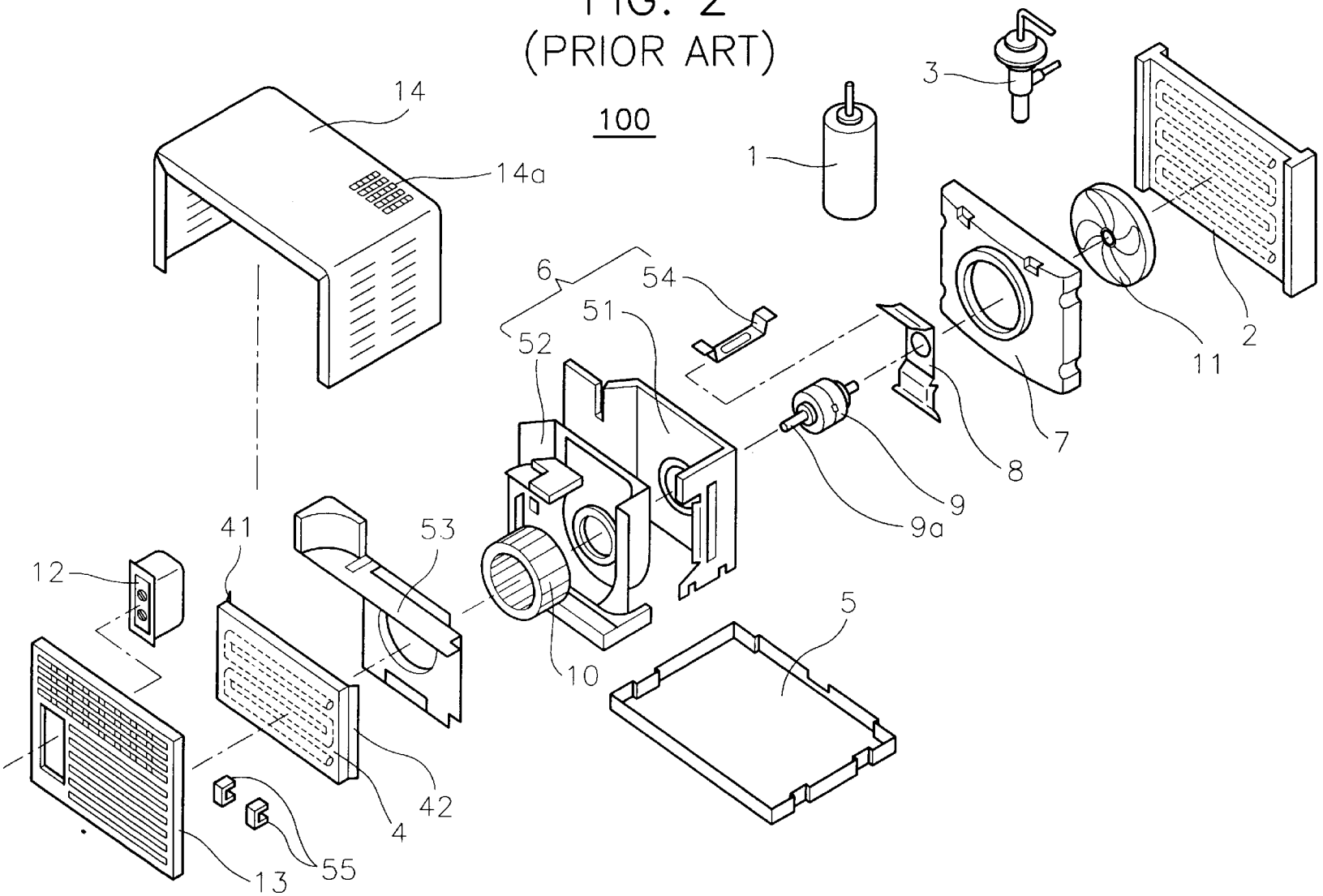
FIG. 2 (PRIOR ART)
FIG. 2 is an exploded perspective view of the conventional room air conditioner shown in FIG. 1.
Figure 3:
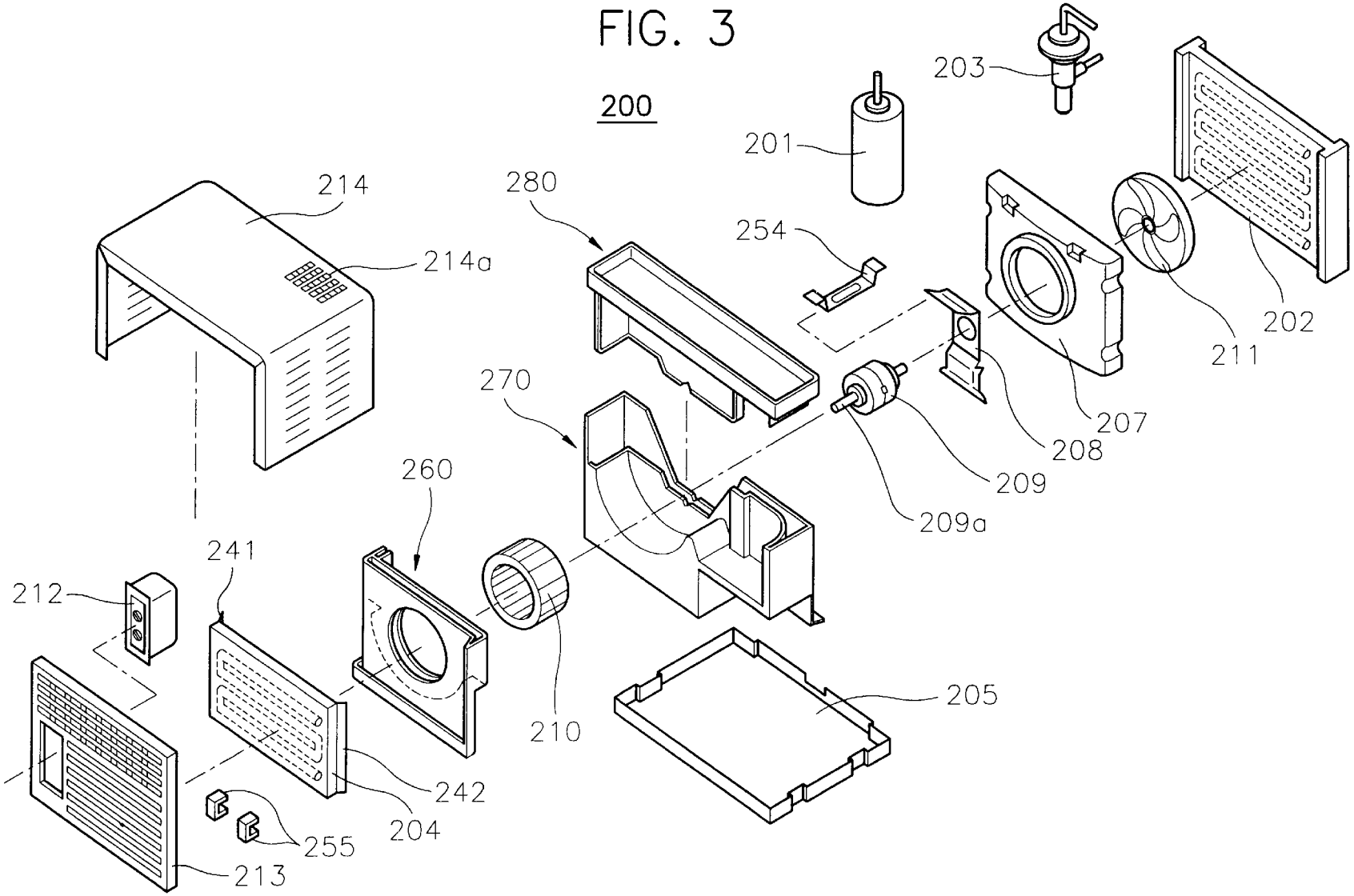
FIG. 3 is an exploded perspective view of a room air conditioner having isolation wall sections according to a preferred embodiment of the present invention.
Figure 4:
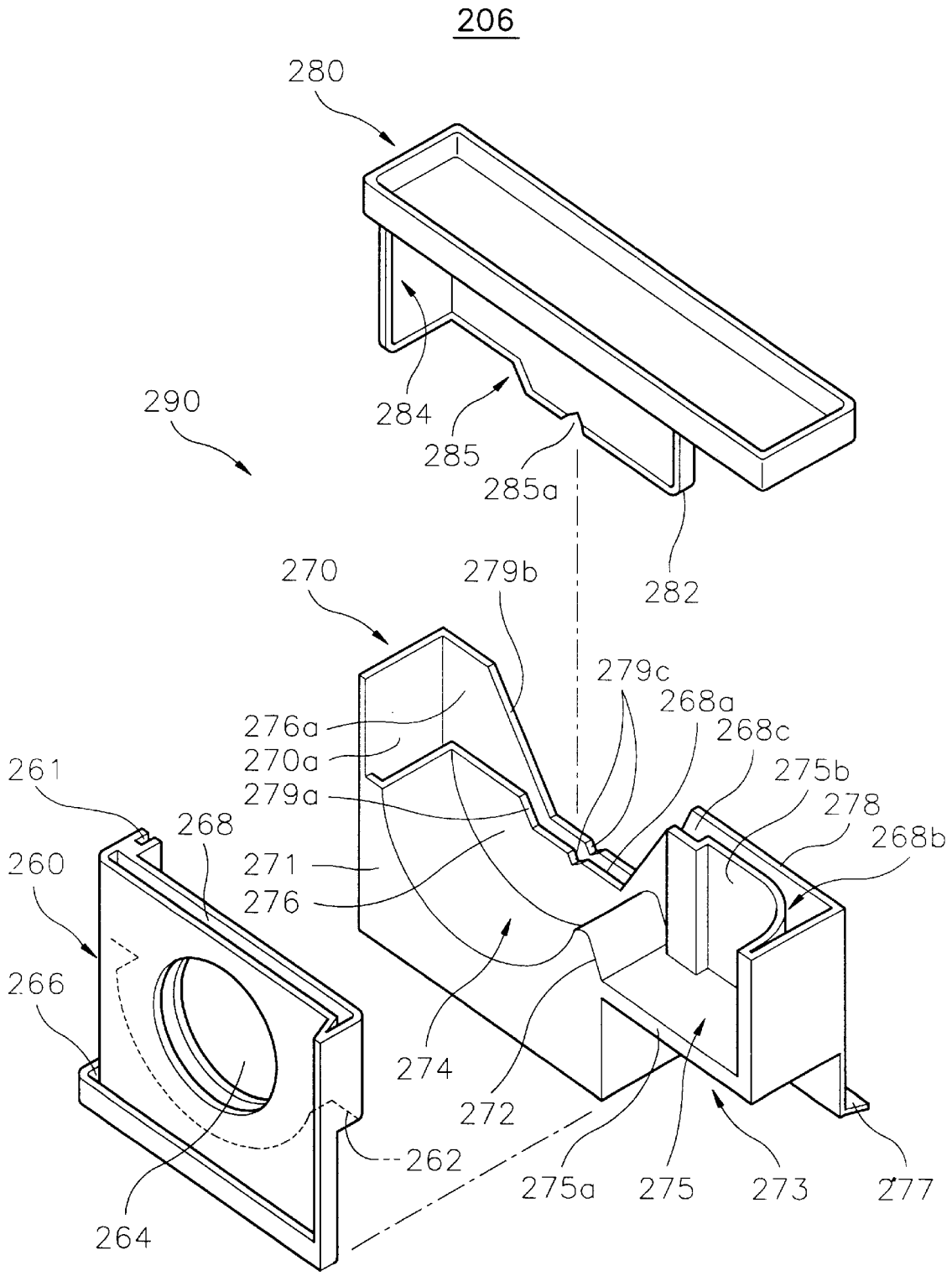
FIG. 4 is an exploded perspective view of a first isolation wall section shown in FIG. 3.
Figure 5:
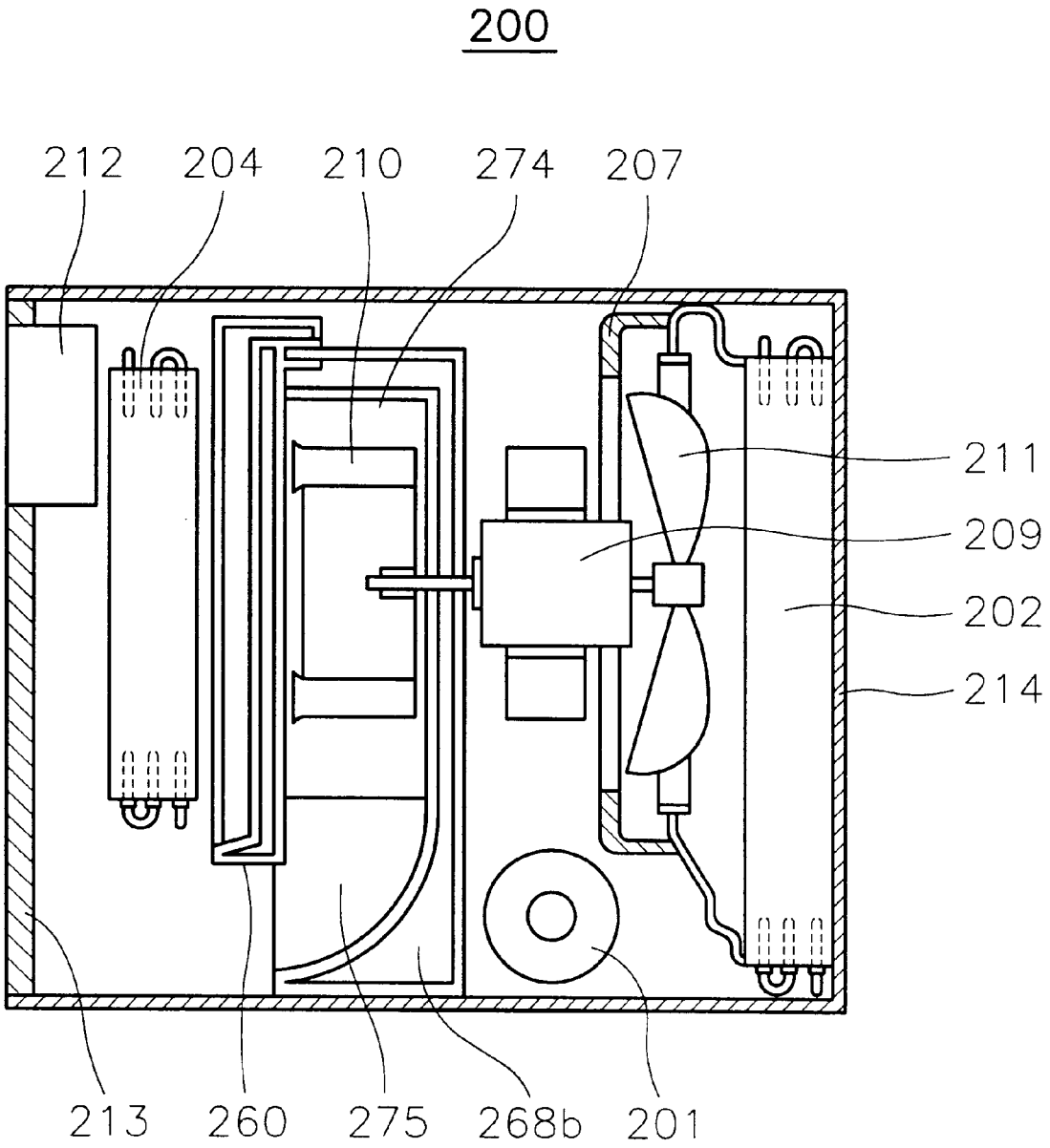
FIG. 5 is a plane sectional view of the room air conditioner according to the present invention.

FIGS. 3 and 4 show room air conditioner 200 having isolation wall sections according to the present invention.

Within room air conditioner 200, an evaporator 204 and a grill sections 213 for uniformly dispersing a conditioned air to a room are positioned toward the room, and a condenser part is extended out of the room so as to be cooled by outdoor air.

Referring to FIGS. 3 and 4, room air conditioner 200, to perform refrigeration cycles, has a compressor 201 for compressing refrigerant gas with a high pressure and a high temperature, a condenser 202 for gradually condensing the high temperature and high pressure refrigerant gas transferred from compressor 201 to a liquid phase by heat radiation, an expansion valve 203 for reducing the pressure of the liquid-phase refrigerant transferred from condenser 202 to change the liquid-phase refrigerant to a low temperature refrigerant in a multiphase of liquid-gas, and an evaporator 204 for evaporating the low temperature multiphase refrigerant with an absorption of environmental heat and transferring the evaporated refrigerant gas to compressor 201.

Room air conditioner 200 further has a base plate 205 for supporting all of the operative components thereon, first and second isolation wall sections 206 and 207 vertically mounted on base plate 205 with predetermined intervals to separate the evaporator part from the condenser part, a driving motor 209 fixed to a motor mount 208 which is vertically assembled on base plate 205 and is located between first and second isolation wall sections 206 and 207, a blower 210 and a fan 211 fixed to both ends of driving shaft 209*a* of driving motor 209, a control unit 212 assembled at first isolation wall section 206 for the control of the room temperature, a grill section 213 assembled in front of first isolation wall section 206 for allowing indoor air to pass therethrough and uniformly dispersing the conditioned air to a room, and a cap member 214 mounted on base plate 205 to cover all the operative components mounted on base plate 205.

Second isolation wall section 207 has a structure assembled on base plate 205 to separate and isolate the condenser part from the evaporator part. Second isolation wall section 207 guides the outdoor air drawn by fan 211 so that the drawn air passes through condenser 202 and then is expelled outside thereof through an outlet port 214*a* of cap member 214.

According to a preferred embodiment of the present invention, first isolation wall section 206 includes a main body 270 which receives a blower 210 coupled to a driving shaft 209*a* of a driving motor 209 fixed to a motor mount 208 mounted at base plate 205 and guides the air passed around evaporator 204 toward grill section 213, an evaporator cover 260 assembled to a front portion of main body 270 for guiding the air drawn by blower 210 toward main body 270, and a head section 280 assembled to an upper portion of main body 270 for exposing an upper portion of main body 270.

Main body 270 is formed at a first side of the upper portion thereof with a first recess 274 having a cylindrical lower surface for receiving blower 210 therein and is formed at a second side of the upper portion thereof oppositely positioned to the first side with a duct 275 which is arcuately bent from first recess 274 toward grill section 213. Duct 275 is communicated with first recess 274 for guiding the air flowing thereinto from first recess 274 toward grill section 213 and is formed therebelow with a first space 273 separated therefrom by a partition 275*a* for receiving a control unit 212 therein.

According to a preferred embodiment of the present invention, a rear wall section of first recess 274 includes first and second rear walls 276 and 276*a* which are spaced apart from each other by a predetermined interval so as to form a second space 268*a* therebetween for attenuating the noise while room air conditioner 200 is being operated. First and second rear walls 276 and 276*a* are formed at upper portions thereof with first and second cut portions 279*a* and 279*b* having trapezoidal shapes, respectively. First and second cut portions 279 and 279*a* are formed at lower edges thereof corresponding to a position of driving shaft 209*a* of driving motor 209 with first grooves 279*c* having half circular shapes so as to allow driving shaft 209*a* to penetrate therethrough when driving motor 209 is installed in the room air conditioner box.

Meanwhile, a third space 268*b* is formed between a rear wall 275*b* of duct 275 and a third rear wall 278 integrally extending from second rear wall 276*a* for attenuating the noise while room air conditioner 200 is being operated.

Second and third rear walls 276*a* and 278 are formed along bottom edges thereof with a rib 277 rearwardly protruding therefrom for fixing main body 270 to base plate 205 when room air conditioner 200 is assembled.

Head section 280 is formed at an underside portion thereof corresponding to first recess 274 of main body 270 with a second recess 284 oppositely shaped with respect to first recess 274 so as to form a cylindrical cavity together with first recess 274 when head section 280 is assembled with main body 270 for stably receiving blower 210 therein.

According to a preferred embodiment of the present invention, a circumferential underside portion 285 of head section 280 has a shape corresponding to a shape of an upper circumferential portion of first rear wall 276. And, second and third rear walls 276*a* and 278 are formed at a connecting portion therebetween with a first vertically elongated groove 268*c* while head section 280 is formed at an underside position thereof corresponding to a position of first vertically elongated groove 268*c* with a vertically elongated rib 282. Accordingly, circumferential underside portion 285 of head section 280 is inserted between first and second rear walls 276 and 276*a*, and vertically elongated rib 282 is slidably inserted into first vertically elongated groove 268*c* so that head section 280 is easily assembled/disassembled with/from main body 270.

Meanwhile, head section 280 is formed at a position of the circumferential underside portion 285 thereof corresponding to a position of first grooves 279*c* formed at first and second cut portions 279*a* and 279*b* of the main body 270 with a second groove 285*a* so as to form a hole together with first grooves 279*c* for allowing driving shaft 209*a* of driving motor 209 to stably penetrate therethrough when head section 280 is assembled with main body 270.

On the other hand, according to a preferred embodiment of the present invention, evaporator cover 260 is a hollow rectangular plate. An inner portion 268 of evaporator cover 260 forms a space for attenuating the noise while room air conditioner 200 is being operated. Evaporator cover 260 is formed at a center portion thereof with a third opening 264 for introducing the air drawn by blower 210 to first recess 274 of the main body 270. Evaporator cover 260 is formed at a side wall thereof with a second vertically elongated groove 261 which is engaged with a side wall 270*a* of first recess 274. Evaporator cover 260 is formed at a rear portion thereof with a shoulder 262 having a shape corresponding to a shape of the lower surface of first recess 274 so as to be engaged with first recess 274 when evaporator cover 260 is assembled with main body 270 so that evaporator cover 260 is easily assembled/disassembled with/from main body 270.

According to a preferred embodiment of the present invention, evaporator cover 260 is formed at a lower portion thereof with a condensate pan 266 for receiving a condensate falling from an outer surface of evaporator 204 and draining the condensate out of the room air conditioner box.

Hereinafter, an assembling process of room air conditioner box having isolation wall section 206 according to the present invention will be described with reference to the accompanying drawings.

At first, condensate pan 266 integrally formed at the lower edge of evaporator cover 260 is secured to base plate 205 by screws (not shown). Then, main body 270 is assembled with evaporator cover 260 in such a manner that shoulder 262 formed at the rear wall of evaporator cover 260 is engaged with first recess 274 of main body 270 and that second vertically elongated groove 261 is engaged with side wall 270*a* of main body 270. Thereafter, rib 277 integrally formed with lower edges of second and third rear wall 276*a* and 278 of main body 270 is secured to base plate 205 by screws (not shown).

Thereafter, head section 280 is assembled to main body 270 in such a manner that circumferential underside portion 285 of head section 280 is engaged with first and second rear walls 276 and 276*a* and vertically elongated rib 282 of head section 280 is inserted into first vertically elongated groove 268*c*.

After first isolation wall section 206 is constructed as described above, second isolation wall section 207 is placed on base plate 205 such that it is spaced apart from first isolation wall section 206 by a brace 254, and then second isolation wall section 207 is secured to base plate 205.

In room air conditioner 200 as described above, when there is an error in blower 210 and accordingly, when there is a need to disassemble blower 210 received in first recess 274 of main body 270 together with driving motor 209 from main body 270, only head section 280 needs to be separated from main body 270 such that the upper portion of main body 270 would be exposed.

In the room air conditioner box having isolation wall sections according to the present invention, the main body, the head section and the evaporator cover are easily manufactured by the injection molding, can be easily assembled/disassembled with/from each other and can attenuate the noise while the room air conditioner is being operated.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A room air conditioner box, which comprises:

a base plate having a rectangular shape;

a cap member assembled at an upper portion of the base plate, the cap member forming a box-shaped space therein together with the base plate, the cap member being formed at a first side wall thereof with a first opening, being formed at a predetermined position of a second side wall thereof oppositely positioned to the first side wall with a second opening so as to allow air to pass therethrough, and being formed at a predetermined position of an upper wall thereof with an outlet port;

a grill section for uniformly and forwardly dispersing a chilled air passed around an evaporator, the grill section being assembled to a circumferential edge portion of the first opening of the cap member;

a first isolation wall section mounted on the base plate for separating the box-shaped space into first and second sub-spaces which respectively face the first and second side walls, preventing a heat exchange between the first and second sub-spaces and attenuating a noise while a room air conditioner is being operated, an upper portion of which is separable; and a second isolation wall section for guiding the air drawn into the second sub-space through the second opening formed at the second side wall toward a condenser and guiding the air passed around the condenser to the outlet port formed at the cap member, wherein the first isolation wall section includes a main body which receives a blower coupled to a driving shaft of a driving motor fixed to a motor mounted at the base plate and guides the air passed around the evaporator installed in the first sub-space toward the grill section, an evaporator cover assembled to a front portion of the main body for guiding air drawn by the blower toward the main body, and a head section assembled to an upper portion of the main body, the main body is formed at a first side of the upper portion thereof with a first recess having a cylindrical lower surface for receiving the blower therein and is formed at a second side of the upper portion thereof oppositely positioned to the first side with a duct which is arcuately bent from the first recess toward the grill section, the duct is communicated with the first recess for guiding the air flowing thereinto from the first recess toward the grill section and being formed therebelow with a first space generated therefrom by a partition for receiving a control unit therein, and a rear wall section of the first recess includes first and second rear walls which are spaced apart from each other by a predetermined interval so as to form a second space therebetween for attenuating the noise while the room air conditioner is being operated, the first and second rear walls are formed at upper portions thereof with first and second cut portions having trapezoidal shapes, respectively, and the first and second cut portions are formed at lower edges thereof corresponding to a position of the driving shaft of the driving motor with first grooves having half circular shapes so as to allow the driving shaft to penetrate therethrough when the driving motor is installed in the room air conditioner box.

2. The room air conditioner box as recited in claim 1, wherein a third space is formed between a rear wall of the duct and a third rear wall integrally extending from the second rear wall for attenuating the noise while the room air conditioner is being operated.

3. The room air conditioner box as recited in claim 2, wherein the second and third rear walls are formed at bottom edges thereof with a rib rearwardly protruding therefrom for fixing the main body to the base plate when the room air conditioner is assembled.

4. The room air conditioner box as recited in claim 1, wherein the head section is formed at an underside portion thereof corresponding to the first recess of the main body with a second recess oppositely shaped with respect to the first recess for forming a cylindrical cavity together with the first recess when the head section is assembled with the main body so as to stably receive the blower therein.

5. The room air conditioner box as recited in claim 1, wherein a circumferential underside portion of the head section has a shape corresponding to a shape of an upper circumferential portion of the first rear wall, the second and third rear walls are formed at a connecting portion therebetween with a vertically elongated groove, and the head section is formed at an underside position thereof corresponding to a position of the vertically elongated groove with a vertically elongated rib, the circumferential underside portion of the head section being engaged with upper circumferential portions of the first and second rear walls, the vertically elongated rib being slidably inserted into the vertically elongated groove so that the head section is easily assembled/disassembled with/from the main body.

6. The room air conditioner box as recited in claim 5, wherein the head section is formed at a position of the circumferential underside portion thereof corresponding to a position of the first grooves formed at the first and second cut portion of the main body with a second groove so as to form a hole together with the first grooves for allowing the driving shaft of the driving motor to stably penetrate therethrough when the head section is assembled with the main body.

7. The room air conditioner box as recited in claim 1, wherein the evaporator cover is a hollow rectangular plate, an inner portion of which forming a second space for attenuating the noise while the room air conditioner is being operated, the evaporator cover being formed at a center portion thereof with a third opening for introducing the air drawn by the blower to the first recess of the main body, being formed at a side wall thereof with a vertically elongated groove which is engaged with a side wall of the first recess, and being formed at a rear portion thereof with a shoulder having a shape corresponding to a shape of the bottom surface of the first recess so as to be engaged with the first recess when the evaporator cover is assembled with the main body so that the evaporator cover is easily assembled/disassembled with/from the main body.

8. The room air conditioner box as recited in claim 1, wherein the evaporator cover is formed at a lower portion thereof with a condensate pan for receiving a condensate falling from an outer surface of the evaporator and draining the condensate out of the room air conditioner box.

* * * * *